United States Patent [19]

Weinberger

[11] 4,376,636

[45] * Mar. 15, 1983

[54] FUEL ADDITIVE

[75] Inventor: Theodor Weinberger, Charlotte, N.C.

[73] Assignee: Adriel Energy Corporation, McLean, Va.

[ * ] Notice: The portion of the term of this patent subsequent to Dec. 1, 2000, has been disclaimed.

[21] Appl. No.: 322,581

[22] Filed: Nov. 18, 1981

[51] Int. Cl.[3] ..... C10L 1/18

[52] U.S. Cl. ..... 44/56; 44/53; 44/77

[58] Field of Search ..... 44/56, 77; 601/53

[56] References Cited

U.S. PATENT DOCUMENTS

| | | | |
|---|---|---|---|
| 1,399,227 | 12/1921 | Rohrs | 44/77 |
| 1,423,049 | 7/1922 | Tunison | 44/77 |
| 2,106,662 | 1/1938 | Savage | 44/56 |
| 2,143,870 | 1/1939 | Ellis | 44/9 |
| 2,496,444 | 2/1950 | Cook | 44/77 |
| 3,511,218 | 5/1970 | Lazaros | 123/119 |
| 3,594,136 | 7/1971 | Rosen | 44/51 |
| 4,207,076 | 6/1980 | Bove | 44/56 |
| 4,231,756 | 11/1980 | King | 44/77 |

*Primary Examiner*—Charles F. Warren
*Assistant Examiner*—Y. Harris-Smith
*Attorney, Agent, or Firm*—Cushman, Darby & Cushman

[57] ABSTRACT

Higher ratios of alcohol to gasoline (gasohol) are possible utilizing gasoline in combination with a mixture of alcohol, a ketone (e.g., acetone) and optionally a small amount of an alkali metal carbonate, such as sodium carbonate, in finely divided form.

15 Claims, No Drawings

FUEL ADDITIVE

BACKGROUND OF THE INVENTION

The present invention relates to an improved fuel mixture for internal combustion engines, notably those engines which are powered by gasoline.

With petroleum resources dwindling throughout the world, efforts are constantly being made to utilize alternative sources of energy. Recently, mixtures of gasoline and alcohol (most notably ethanol) have been touted as but one means of an alternate means of saving energy. In order to increase the use of such gasohol products, there is a need for increasing the proportion of alcohol which can be used in such mixtures without a loss in performance or damage to the engine. Current gasohol products contain approximately 10 percent by volume alcohol with the balance being chiefly gasoline together with conventional additives (e.g. combustion catalysts, etc.).

Prior to the recent commercialization of gasohol products, a variety of alternatives to gasoline per se had been suggested for use in internal combustion engines as exemplified in U.S. Pat. Nos. 1,399,227 and 1,423,049. However, the use of gasohol appears to offer the great potential for the reduction of petroleum consumption, particularly if greater proportions of alcohol can be effectively incorporated into the fuel mixture.

Accordingly, it is the primary object of the present invention to provide an additive for gasoline in combination with alcohol which will enable one to fuel an internal combustion engine with larger proportions of alcohol than utilized herebefore.

It is a further object of the present invention is to employ a fuel mixture containing a substantial amount of alcohol and which meets or exceeds both federal and state emission requirements.

These and other objects of the present invention will be more apparent from the discussion which follows hereinafter.

SUMMARY OF THE INVENTION

The present invention is directed to an admixture which used in combination with various ratios of gasoline and alcohol enables higher proportions of alcohol to be effectively employed without sacrificing performance or damaging the internal combustion engine.

Specifically, the alcohol and additive mixture of the present invention consists essentially of an alcohol and from about 3 to about 40 percent and preferably 20 to about 30 percent by volume, based on the alcohol of a ketone having the general formula $$R_1-\overset{\overset{\displaystyle O}{\|}}{C}-R_2$$

wherein $R_1$ and $R_2$, which may be the same or different, are each an alkyl of 1 to 4 carbon atoms, and up to about 1.5 grams (e.g., from about 0.3 to about 1.5 grams, and preferably 0.36 to 1.2 grams), per gallon of the alcohol and ketone mixture of an alkali metal carbonate in finely divided form.

Currently as noted, alcohol such as methyl alcohol, ethyl alcohol or mixtures thereof is added in an amount of about 10 percent by volume of gasoline mixtures to form a fuel mixture referred to as gasohol. This alcohol is generally at least 190 proof. Alcohols containing greater amounts of moisture heretofor have been considered unsuitable as for use in gasoline mixtures as such low proof alcohols are inefficient and potentially hazardous to the engine due to their high water content. The addition of a ketone in accordance with the present invention optionally in combination with the finely divided alkali metal carbonate (e.g. in the form of a powder 100 mesh or finer) enables one to utilize not only a greater proportion of alcohol in combination with the gasoline (e.g., even up to about 65 percent by volume additive), but also permits the use of alcohols containing a greater amount of moisture (e.g., as low as 170 proof).

The invention further embodies a fuel additive consisting essentially of a ketone having the general formula $$R_1-\overset{\overset{\displaystyle O}{\|}}{C}-R_2$$

wherein $R_1$ and $R_2$, which may be the same or different, are each an alkyl of 1 to 4 carbon atoms and from about 10 to about 15 grams of an alkali metal carbonate in finely divided form per gallon of ketone.

Thus, there is provided in accordance with one embodiment of the present invention a fuel suitable for operating an internal combustion engine which comprises from about 35 to 90 percent and suitably about 60 to about 70 percent by volume gasoline and up to 65 percent (preferably from about 30 to 40 percent) by volume of the alcohol and additive mixture described hereinabove. Suitably the fuel mixture contains from about 60 to 90 percent by volume gasoline and from about 40 to 10 percent by volume of said alcohol and additive mixture. An especially preferred ratio is 65 percent gasoline and 35 percent alcohol and additive mixture.

A number of advantages flow from the use of the fuel admixtures called for in the present invention. Of particular note is the ease with which an engine will start in cold weather. In addition, the fuel mixture of the present invention burns cleaner and exhibits less carbon deposit than current gasohol or gasoline fuels. The resulting fuel mixture meets or exceeds federal and state emission requirements.

As noted, the alcohol and additive mixture contains up to about 40 percent, and suitably from about 20 to about 30 percent based on the weight of the alcohol of a ketone having the formula noted above. While a variety of ketones could be employed, an especially preferred ketone is selected from the group consisting of acetone, methyl-ethyl ketone or mixtures thereof. Acetone is especially preferred due to its ready availability and low cost. The amount of ketone may vary within the range stated and preferably ranges from about 25 percent based on the volume of the alcohol.

The alkali metal carbonate most suitable is sodium carbonate, but it is also envisioned that one might employ with equal efficiency potassium carbonate, lithium carbonate or mixtures thereof in a finely divided state. The carbonate must be in a sufficiently fine divided state to readily mix with the alcohol, acetone and gasoline and not clog fuel jets or lines. Thus, powdered particles of at least 100 mesh or finer are preferred. The carbonates serve to enhance the fuel mixture by apparently controlling the amount of water which may be present. When used only a small amount of the carbonate need be present and generally from about 0.3 to about 1.5 grams per gallon of the alcohol and ketone mixture need be employed. Preferably one utilizes approximately 0.36 to 1.2 grams of the carbonate per gallon of alcohol and ketone mixture.

An especially preferred fuel mixture according to the present invention comprises:

about 60 to 70% by volume gasoline; and about 40 to 30% by volume of an alcohol and additive mixture consisting essentially of:

about 86 to 63 percent by volume ethanol;

about 37 to 14 percent by volume of a ketone selected from the group consisting of acetone, methylethyl ketone and mixtures thereof; and optionally about 0.3 to 1.5 grams of sodium carbonate per gallon of alcohol and ketone mixture.

The presence of the ketone in combination with the alcohol appears to enhance the combustibility of the resulting fuel mixture when admixed with gasoline. The fuel additive may be employed both with unleaded as well as leaded type gasolines currently available on the market.

Insofar as the prepration of the fuel additive or resulting fuel mixture is concerned, there is no criticality in the mode by which the ingredients are blended. Thus, the carbonate may be added directly to the alcohol or mixtures of the alcohol and acetone. Alternatively, the ingredients may be individually, and with no critical order of addition, added to the gasoline within the proportions described.

The following examples are offered in order to more fully illustrate the invention, but are not to be construed as limiting the scope thereof.

EXAMPLE 1

A gasoline additive was prepared by thoroughly mixing together the following materials in the amounts indicated:

acetone 1 gallon sodium carbonate 12 grams per gallon of acetone in powder form.

EXAMPLE 2

The additive of Example 1 was mixed with varying amounts of unleaded regular gasoline and alcohol (190 proof ethanol). The resulting fuel mixture was then tested in a 1979 Dodge Aspen equipped with a 2-barrel carburetor. The tests were carried out at 50 mph. Fuel mileage figures were determined by taking a minimum of five tests and averaging the totals. For purposes of comparison, tests were also run using unleaded regular gas. The results are set forth in Table I.

TABLE I

| Test No. | Volume Gasoline | Volume Alcohol | Additive (oz.) | Miles per gallon | Hydro-carbons ppm | CO % |
|---|---|---|---|---|---|---|
| 1 | 100 | — | — | 19.78 | 84 | .56 |
| 2 | 60 | 40 | 8 | 16.66 | 47 | .01 |
| 3 | 70 | 30 | 7 | 17.4 | 73 | .01 |
| 4 | 75 | 25 | 6 | 19.4 | 56 | .02 |

EXAMPLE 3

Tests were conducted using a variety of motor vehicles employing varying ratios of gasoline, ethanol and acetone. The tests were conducted at 50 to 55 mph unless noted otherwise, and fuel mileage figures were determined by taking a minimum of three tests and averaging the totals. For comparative purposes, the tests were also run in each vehicle using the unleaded regular gas alone. The results are set forth in Table II.

TABLE II

| Car* | Percent Volume Gasoline | Percent Volume Ethanol | Proof Ethanol | Percent Acetone Volume | Miles Per Gallon |
|---|---|---|---|---|---|
| A | 100 | — | — | — | 18.3 |
| A | 70 | 20 | 200 | 10 | 21.6 |
| A | 60 | 30 | 200 | 10 | 21.0 |
| A | 75 | 15 | 190 | 10 | 24 |
| A | 75 | 15 | 190 | 10 | 20.0 (at 40 mph) |
| A | 70 | 15 | 190 | 10 | 20.0 |
| A | 60 | 30 | 190 | 10 | 20.0 |
| A | 70 | 20 | 190 | 10 | 20.0 |
| B | 100 | — | — | — | 24.6 |
| B | 80 | 18 | 189 | 2 | 20.2 (at 40 mph) |
| B | 75 | 18 | 190 | 7 | 23.2 |
| B | 70 | 20 | 190 | 10 | 22.3 |
| B | 75 | 25 | 190 | 5 | 24.0 |
| B | 75 | 20 | 190 | 5 | 26.6 |
| C | 100 | — | — | — | 22.9 |
| C | 70 | 20 | 190 | 10 | 21.0 |
| C | 70 | 20 | 200 | 10 | 22.3 |
| D | 100 | — | — | — | 13[x] |
| D | 70 | 20 | 190 | 10 | 11.4[x] |
| D | 60 | 30 | 190 | 10 | 11.4[x] |
| D | 70 | 25 | 190 | 5 | 18.0 |
| D | 65 | 25 | 190 | 10 | 18.0 |
| D | 40 | 40 | 180 | 20 | 18.5 |
| D | 40 | 40 | 190 | 20 | 19.0 |

A - 1981 Chrysler Automatic Slant 6 Engine
B - 1974 Pinto, 2300 cc 4 cylinders
C - 1979 Chevrolet SW, U-8 305 Engine
D - 1980 Mercury SW
[x]- Simulated city driving - 25 mph Overall, the results of the foregoing examples demonstrate the unexpected performance of the additive and resulting fuel mixture.

The additive was also found to be effective at both speeds of 35 as well as 55 miles per hour. Additional observations included idling periods and acceleration and deceleration at stop lights, shopping center parking lots, and other specifically designated points.

While certain representative embodiments and details have been shown for the purpose of illustrating the present invention, it will be apparent to those skilled in the art that various changes and modifications may be made therein without departing from the spirit and scope of the invention. It will further be understood that the invention may comprise, consist essentially of or consist of the steps or materials recited herein.

I claim:

1. A gasoline additive mixture consisting essentially of alcohol mixed with from about 3 to about 40 percent, based on the volume of said alcohol, a ketone having the general formula $$R_1-\overset{\overset{\displaystyle O}{\|}}{C}-R_2$$

wherein $R_1$ and $R_2$, which may be the same or different, are each an alkyl of 1 to 4 carbon atoms, and from about 0 to about 1.5 grams per gallon of said additive mixture of an alkali metal carbonate in finely divided form.

2. The additive of claim 1 wherein said alkali metal carbonate is present in an amount ranging from 0.3 to 1.5 grams per gallon.

3. The additive of claim 1 wherein said ketone is selected from the group consisting of acetone, methyl-ethyl ketone and mixtures thereof.

4. The additive of claim 1 or 2 wherein said alkali metal carbonate is sodium carbonate.

5. The additive of claim 1 or 2 wherein said ketone is present in an amount ranging from about 20 to about 30 percent based on the volume of said alcohol.

6. The additive of claim 5 wherein said alcohol is methyl alcohol, ethyl alcohol or mixtures thereof.

7. The additive of claim 6 wherein said carbonate is present in an amount ranging from about 0.36 to 1.2 grams per gallon.

8. A fuel additive consisting essentially of a ketone having the general formula:

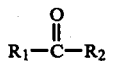

wherein $R_1$ and $R_2$, which may be the same or different, are each an alkyl of 1 to 4 carbon atoms and from about 10 to about 15 grams of an alkali metal carbonate in finely divided form per gallon of ketone.

9. The additive of claim 8 wherein said ketone is selected from the group consisting of acetone, methyl-ethyl ketone and mixtures thereof.

10. The addition of claim 8 consisting essentially of acetone and about 12 grams of sodium carbonate.

11. A fuel for an internal combustion engine comprising from about 35 to 90 percent by volume gasoline and from about 65 to 10 percent by volume of the additive of claim 1 or 2.

12. The fuel of claim 11 comprising from about 60 to 70 percent by volume gasoline and from about 40 to 30 percent by volume of said additive.

13. The fuel of claim 11 comprising:

about 60 to 70 percent by volume gasoline; and about 40 to 30 percent by volume of an alcohol and additive mixture consisting essentially of:

about 86 to 63 percent by volume ethanol; and about 37 to 14 percent by volume of a ketone selected from the group consisting of acetone, methyl-ethyl ketone and mixtures thereof.

14. The fuel of claim 10 further comprising about 0.36 to 1.2 grams of sodium carbonate in finely divided form per gallon of additive mixture.

15. A method for fueling an internal combustion engine which comprises feeding to said engine under combustion conditions the fuel of claim 8.

* * * * *